United States Patent [19]

Camp et al.

[11] 3,938,700

[45] Feb. 17, 1976

[54] MULTI-RACK ARTICLE DISPENSING APPARATUS

[75] Inventors: Vernon Doyle Camp; Harry R. Payne, both of Chattanooga, Tenn.

[73] Assignee: Cavalier Corporation, Chattanooga, Tenn.

[22] Filed: Nov. 25, 1974

[21] Appl. No.: 527,156

[52] U.S. Cl. ..... 221/109; 193/32

[51] Int. Cl.[2] ..... G07F 11/12

[58] Field of Search ..... 221/11, 107, 108, 109, 221/295, 296, 301, 103; 193/32, 27

[56] References Cited

UNITED STATES PATENTS

| | | | |
|---|---|---|---|
| 2,124,500 | 7/1938 | Taylor | 221/109 |
| 2,727,654 | 12/1955 | Childers et al. | 221/301 X |

*Primary Examiner*—Drayton E. Hoffman
*Assistant Examiner*—Frederick R. Handren
*Attorney, Agent, or Firm*—Cameron, Kerkam, Sutton, Stowell & Stowell

[57] ABSTRACT

In a multi-rack can vending machine, an article release mechanism for controllably releasing articles from an article rack automatically into a vertical access as the article level in the access is lowered. The article release is a spring retained flapper plate which pivots about a pivot support to release multiple articles on demand. The flapper plate is normally retained against the force of the spring in an article retaining position until the level of articles in the access is sufficiently low to allow the flapper plate to pivot without contacting the uppermost article. Generally, two articles of sufficient weight are required on the flapper plate in order to overcome the force of its retaining spring to actuate the pivotal release of the two articles into the access.

5 Claims, 4 Drawing Figures

MULTI-RACK ARTICLE DISPENSING APPARATUS

BACKGROUND OF THE INVENTION

Briefly described, the dispensing mechanism of the present invention includes a gravity feed system for storing articles compactly in large numbers and for dispensing the articles by gravity without requiring independent power means other than a simple release mechanism. This gravity vertical access feed system comprises a gravity feed main supply disposed for containing a column of articles, escapement means at the lower end of the supply chute for dispensing articles singly therefrom, and a plurality of inclined racks arranged along the vertical access and opening thereinto for storing articles in each rack when the article column in the access extends therebeyond and for supplying articles by gravity from each rack to the upper end of the article column as the upper end of the column of articles progresses past the storage rack. This arrangement of inclined racks opening into a main vertical access provides for compact storage and feeding of articles with the weight of the articles providing sufficient gravity force for operating the release mechanism, but without undue pressure on the article supply even when a large number of articles are in the supply. In addition, this arrangement permits the use of a flapper plate conveniently insertable under the articles in a particular rack and into the main chute to block the passage of articles so that repair or replacement of the release mechanism can be accomplished without the tedious removal of all of the articles from the dispensing mechanism.

The prior art patents for mechanically releasing articles detect the presence or absence of an article already released. When there is an article present, the actuator prevents the mechanical release mechanism from dispensing; however, as shown in U.S. Pat. No. 3,368,714, issued to Wingate et al., when there is no article present in the access to retain the release mechanism in its article blocking position, the mechanical release dispenses the can into the vertical access. Many of the prior art patents having mechanical releases use devices above the rack which block the path of travel from the inclined rack to the access. Generally, these devices have pivotably mounted flapper plates which are kept shut by the presence of articles released from above the inclined rack. As the level of articles in the access lowers past the inclined rack, the weight of the stack of articles pushing against the flapper plate pivots it open and keeps it open until the last article in the rack is released. Examples of this type of mechanical release are shown in the patents issued to Dennis, U.S. Pat. No. 2,408,380, and Voigtritter, U.S. Pat. No. 2,531,347.

The prior art patent to Crittenden, U.S. Pat. No. 481,896, shows but another type of mechanical release mechanism where an article waiting to be dispensed is detected by a lever which cooperates with a pivotal flapper plate to prevent the release of more articles from the inclined rack.

While the prior art shows mechanical can releases which sense the presence of a first can in the vertical access and, thereby, prevents the release of a second can from the inclined rack, these devices are usually complicated and expensive to install in new or existing machines.

SUMMARY OF THE INVENTION

It is therefore the object of this present invention to provide a novel article releasing mechanism which is of sturdy and strong construction, simple and easy to manufacture and maintain, and not subject to malfunction.

In the present invention, the article release mechanism is located at the lower end of a generally inclined rack filled with articles, which the lowermost article in position to be released into a vertical access, where the articles are retained until released by a suitable dispensing mechanism. The articles move down the inclined rack by gravity, rolling at right angles to their long axis to be dispensed at the same posture and roll out of a receiver to be picked up by the purchaser. Generally, a vending machine will have many inclined racks stacked one on top of another forming a dispensing column which releases cans to the vertical access. In addition, a typical vending machine will have several rows of individual columns; however, my invention will work with a single column comprising as few as two inclined racks stacked one on top of the other. At the rear of each inclined rack, which is the lower end of the rack, there is a flapper plate for retaining the articles on the inclined rack until the level of articles in the vertical access is sufficiently lowered, at which time the articles in the inclined rack are released in multiples of two until the vertical access is again filled. The flapper plate includes a top portion extending into the inclined rack to retain the articles on the rack and a bottom portion which extends into the vertical access contacting the uppermost article preventing the two lowermost articles in the rack from being released. The flapper plate is a unitary construction having a horizontal pivot separating the top and bottom portions with an article retaining lip near the end of the top portion. There is a retaining spring to keep the flapper plate parallel to the inclined rack when there are no articles present, either on the inclined rack or in the vertical access.

BRIEF DESCRIPTION OF THE DRAWINGS

In the accompanying drawings in which like reference characters indicate like parts.

DESCRIPTION OF THE PREFERRED EMBODIMENT

Figure 1:
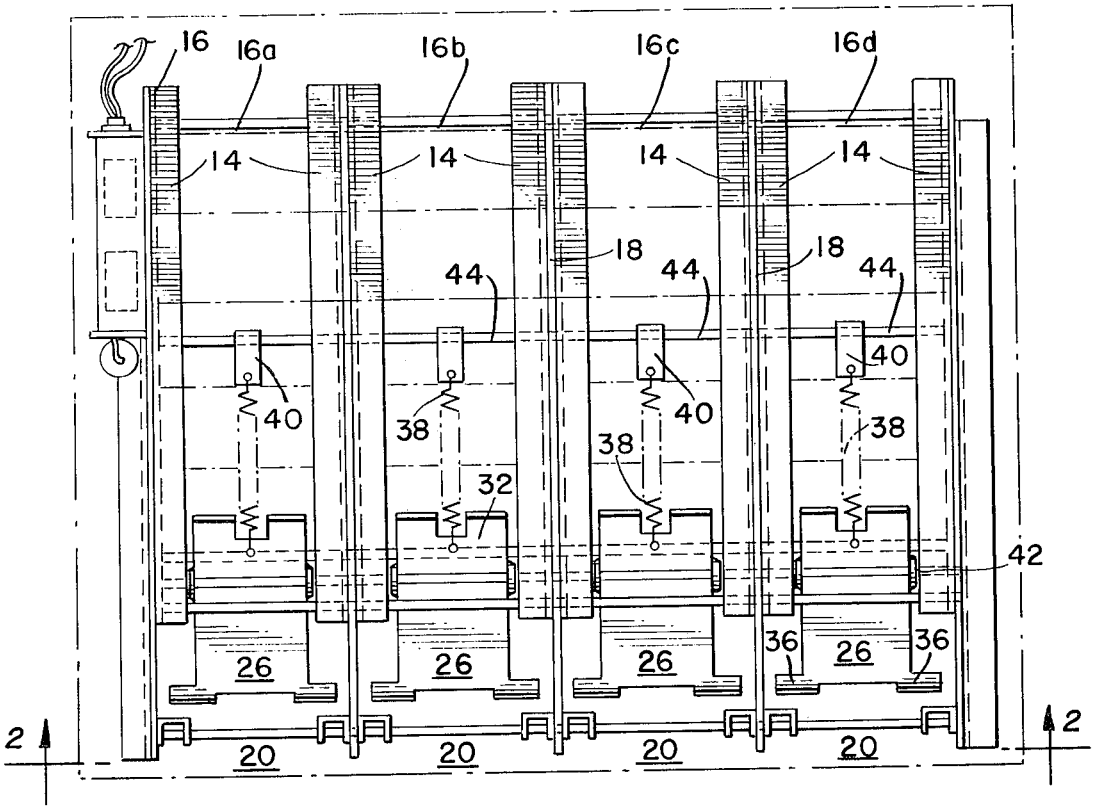
FIG. 1 is a top plan view of a preferred embodiment of the article release mechanism of the present invention showing the same installed at the end of an inclined rack of articles.
Figure 2:
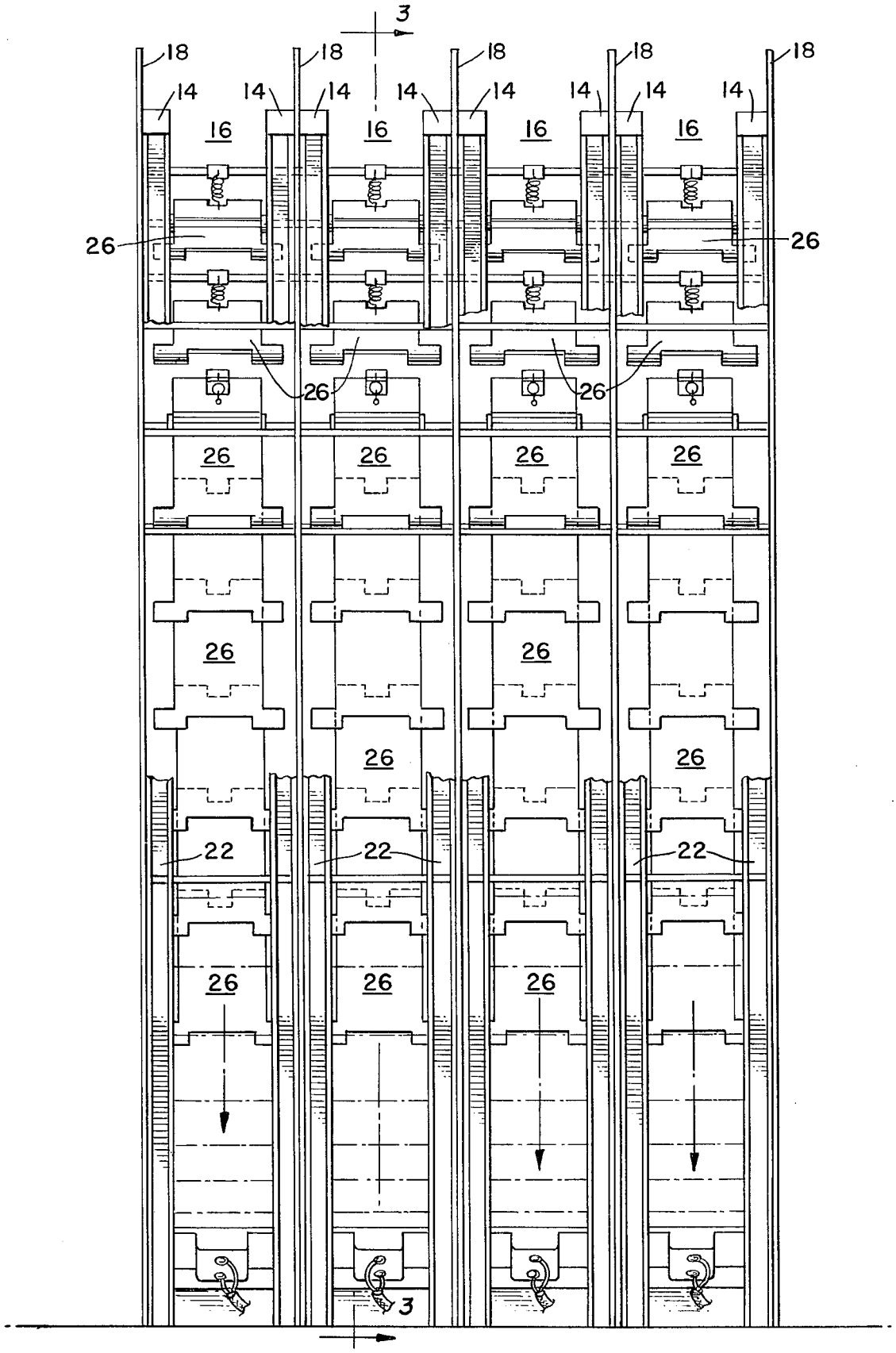
FIG. 2 is an end view of the inclined racks of a multiple-rack mechanism showing the release mechanism of this invention.
Figure 3:
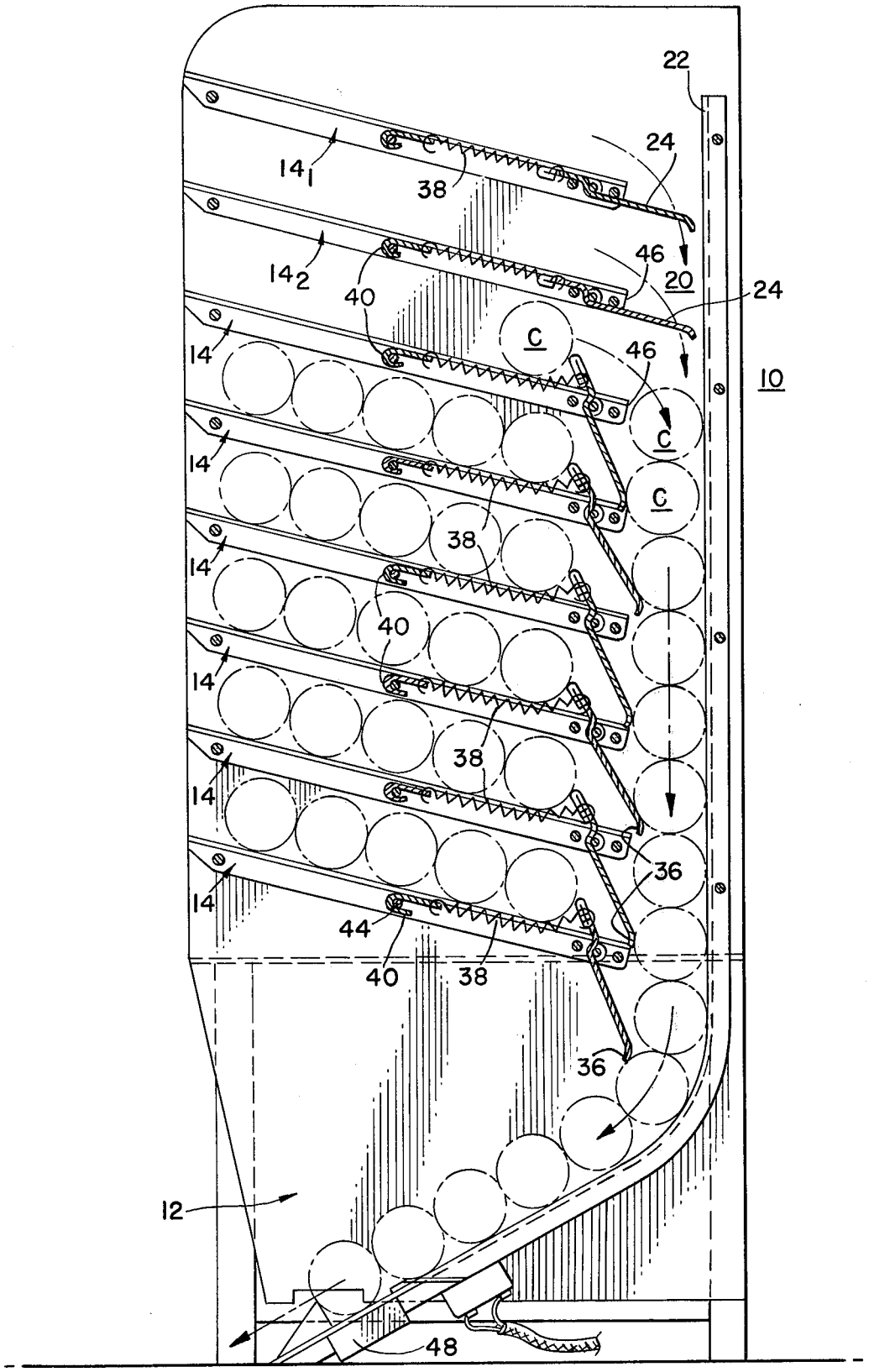
FIG. 3 is a view from the right of FIG. 1 with the side panel removed and showing how the articles are released from the top down.

Referring now to FIG. 3, there is shown a coin-operated vending machine 10 with a bottom access 12 for dispensing canned beverages and other packaged goods, in particular packaged foods, on the insertion of a coin and selection by a customer; for purposes of this description where the term "article" is used, it is intended to include other packaged articles such as cans or bottles, for example. The machine 10 comprises a series of inclined racks 14 partitioned into individual columns 16*a*, 16*b*, 16*c* and 16*d* (see FIG. 1) by vertical support walls 18, as shown in FIGS. 1 and 2. The inclined racks 14 slant from front to back such that the articles C are loaded from the front of the machine 10 and travel down the incline by gravity to the lower end of the rack 14. Illustratively, the racks 14 are inclined at an angle with respect to the horizontal in the order of 14°. At the rear of the machine 10, there is a vertical access 20 which runs from the top to the bottom of the machine 10 and comprises a metal chute which has an inclined lower end. Articles C from the individual columns 16 are released into the access 20, which is divided to keep the articles C in each column 16 separated therein, and travel down the access 20 by gravity to be dispensed to a purchaser by a coin-actuated vending mechanism 48, illustratively of the type disclosed in U.S. Pat. No. 3,613,854.

To preclude the possibility of jamming, each of the inclined racks 14 includes an article release mechanism 24 (see FIG. 4) mounted near the rear end of each rack 14, as shown in FIG. 3. Each article release mechanism 24 includes a flapper plate 26 (see FIG. 4), which is divided by horizontal pivot supports 28 into an article support portion 30 and an article retaining portion 32. The article retaining portion 32 is notched and has a spring receiving aperture 34. Projecting outwardly from the lower end of the can support end 30 are stops 36 which engage the next, lower inclined rack 14; the purpose of the stop 36 will be explained in detail later. A retaining spring 38 is connected at one end to the aperture 34 of the flapper plate 26 and at the other end to a hook 40 which is connected to a rod 44.

Figure 4:
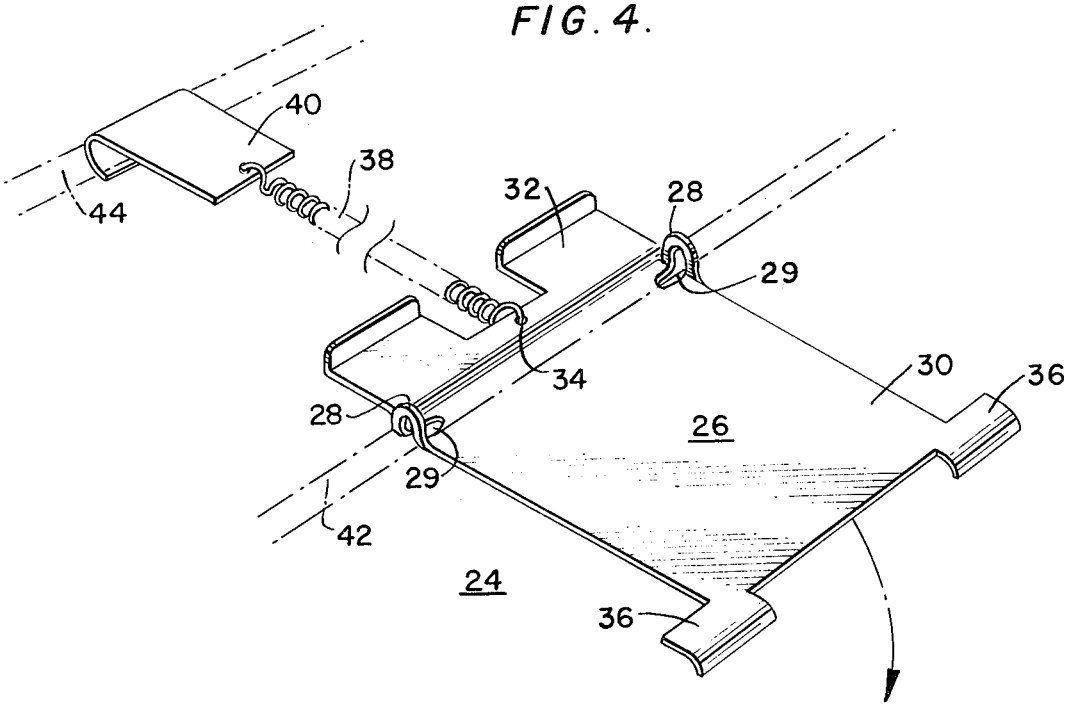
FIG. 4 is an enlarged detailed perspective view of the release mechanism of this invention.

Running horizontally across the rear of each rack 14 are parallel rods 42 and 44. The pivot supports 28 of each flapper plate 26 are connected to the rods 42 by running the rods 42 through the pivot holes 29 in the pivot support 28. The hook 40 of the retaining spring 38 is connected to rod 44 in such a manner that the tension of spring 38 retains the unloaded flapper plate 26 in a horizontal plane as shown in FIG. 4. Looking at FIG. 3, it is seen that the flapper plate 26 of the two empty racks $14_1$ and $14_2$ are retained horizontally by the spring 38.

When the vending machine 10 is to be filled, the vertical access 20 is filled first from the top and then the topmost inclined rack 14 and succeeding lower racks are filled in order, with the presence of the articles C in the access 20 retaining the flapper plate 26 in the vertical position against the force of spring 38. The other inclined racks 14 are filled in sequence until all racks 14 are filled. In the filled position, the weight of the articles C on the racks 14 presses against the retaining top portion 32 of the flapper plate 26, preventing any articles C from being released into the vertical access 20. When the level of the articles C in the access 20 is lowered, the spring force of the spring 38 pivots the flapper plate 26 upward, and the top portion 32 releases two additional articles C onto the flapper plate 26 for release into the access 20. It should be clear that the articles C travel down the inclined rack 14 by gravity and the articles C are also loaded onto the flapper plate 26 by gravity.

So that no more than two articles are dispensed at any one time, flapper plate top portion 32 is pivoted into the path of the next article C on the rack 14, stopping it from further travel. The articles C will continue to be released in this manner until all of the articles C are released in pairs into the access 20 and the next rack 14 will empty, and so on.

With the inclined rack 14 filled, the weight of the articles C could easily overcome the retaining spring 38, pivoting the bottom portion 30 of the flapper plate 26 out of the path of the articles C and releasing the articles C into the access 20. In order to prevent this, the flapper plate bottom portion 30 is equipped with wing stops 36 which engage the lower ends 46 (see FIG. 3) of the next, lower rack. The stops 36 therefore serve the vital function of preventing the bottom portion of flapper plate 26 from rotating past the lower end 46 of the next, lower rack 14 by contacting the rack 14, thereby holding back the articles C.

The foregoing detailed description of the preferred embodiment of the dispensing mechanism of the present invention has been presented for purposes of illustration only and it should be understood that the details may be varied within the scope of the present invention. Numerous other variations are within the intended scope and the invention also may be incorporated in various devices other than article vending mechanisms. The scope of the present invention is not intended to be limited other than as defined in the appended claims.

What is claimed is:

1. Article dispensing apparatus comprising:

a. support means including first and second racks, said first rack disposed above said second rack and each of said racks including an upper end and a lower end, whereby articles travel by force of gravity therealong toward said lower end;

b. a vertical access disposed at the lower end of each of said inclined racks and in communication therewith with an exit opening of each of said racks for receiving articles therethrough;

c. an article releasing plate pivotably mounted at said lower end of at least said second rack, said article releasing plate comprising a first upper portion and a second lower portion and disposable from a first, article retaining position, wherein said lower portion is disposed in contact with an article in said vertical access, while permitting downward movement of articles through said vertical access, and said upper portion is disposed into a blocking relationship with the articles in said first rack thereabove, to a second, article releasing position, wherein said second lower portion is free of articles in said access and said upper portion is removed from a blocking position of the articles in the first rack; and d. spring means for urging said article releasing plate to its second, article releasing position.

2. An article dispensing mechanism as in claim 1 and wherein said spring means for pivoting said releasing plate is a retaining spring which retains the releasing plate in a plane substantially parallel to the planes of said racks when there are no articles present in said vertical access to block said releasing plate and the articles have been emptied from said inclined rack.

3. In a vending machine, a plurality of inclined article racks attached in a vertical column to dispense articles, a vertical access for receiving articles from said racks, each of said racks having a lower end, an article release mechanism pivoted to said lower end of each of said racks, means for controlling said articles in said rack to prevent the release of articles when said release mechanism contacts an article in said vertical access, comprising a releasing plate having a first and a second portion divided by a pivot support, said first portion being longer than said second portion and being of a size to support a plurality of articles, said second portion being in the same plane as said first portion and being of a size to prevent articles from being released from said inclined rack.

4. In a vending machine as in claim 3 and wherein said spring means for controlling said articles in said rack is connected to said releasing plate, whereby said spring means pivots said releasing plate horizontally.

5. In a vending machine as in claim 3, wherein said second portion has a leading, stop portion adapted to engage the front of a lower rack, whereby said releasing plate is prevented from further rotation.

* * * * *